US005359933A

United States Patent [19]

Blaser et al.

[11] Patent Number: 5,359,933

[45] Date of Patent: Nov. 1, 1994

[54] CLAMPING AND TENSIONING DEVICE FOR A PRINTING PLATE IN A PRINTING MACHINE

[75] Inventors: Peter T. Blaser, Dielhelm; Karl-Hermann Miltner, Dossenheim; Anton Rodi, Leimen, all of Germany

[73] Assignee: Heidelberger Druckmaschinen AG, Heidelberg, Germany

[21] Appl. No.: 39,883

[22] Filed: Mar. 30, 1993

[30] Foreign Application Priority Data

Mar. 30, 1992 [DE] Germany ..... 4210316

[51] Int. Cl.[5] ..... B41F 27/12

[52] U.S. Cl. ..... 101/415.1; 101/409; 101/410; 101/378; 101/383; 101/382.1

[58] Field of Search ..... 101/415.1, 378, 382.1, 101/383, 384, 409, 410

[56] References Cited

U.S. PATENT DOCUMENTS

| | | | |
|---|---|---|---|
| 3,012,841 | 12/1961 | Autere et al. | 101/415.1 |
| 3,715,981 | 2/1973 | Huffman | 101/415.1 |
| 4,133,264 | 1/1979 | Fermi et al. | 101/415.1 |
| 4,421,024 | 12/1983 | Burger et al. | 101/415.1 |
| 4,848,229 | 7/1989 | Grosshauser et al. | 101/378 |
| 4,890,555 | 1/1990 | Bryer et al. | 101/415.1 |
| 4,938,134 | 7/1990 | Dorsam et al. | 101/378 |
| 4,938,135 | 7/1990 | Wieland | 101/415.1 |
| 5,003,878 | 4/1991 | Dorow et al. | 101/378 |
| 5,181,469 | 1/1993 | Merkel et al. | 101/415.1 |
| 5,184,554 | 2/1993 | Merkel et al. | 101/415.1 |

FOREIGN PATENT DOCUMENTS

| | | |
|---|---|---|
| 0411371 | 2/1991 | European Pat. Off. . |
| 4129831 | 7/1992 | Germany . |
| 63-191636 | 8/1988 | Japan . |

*Primary Examiner*—Edgar S. Burr
*Assistant Examiner*—Lynn D. Hendrickson
*Attorney, Agent, or Firm*—Herbert L. Lerner; Laurence A. Greenberg

[57] ABSTRACT

Clamping and tensioning device for an inwardly bent trailing edge of a flexible printing plate disposed in an axial gap at the circumference of a plate cylinder adjustable in axial spacing and cooperating with a blanket cylinder, the printing plate being fixable at a leading edge thereof on the plate cylinder and being tensionable in circumferential direction on the plate cylinder, includes two clamping bars displaceably supported in the axial gap and forming therebetween a clamping slot for receiving therein an inwardly bent trailing edge of the printing plate, the two clamping bars extending axially in the gap within the cross-sectional contour of the plate cylinder and being loadable by reversible opposing clamping forces as well as by reversible tensioning forces in common in tensioning direction of the printing plate, and being respectively braced against the plate cylinder, the two clamping bars being formed with radially outer edges, the clamping and tensioning device being radially displaceably disposed in the axial gap of the plate cylinder, and a device for applying drive forces to the clamping and tensioning device for displacing the clamping and tensioning device with the radially outer edges of the two clamping bars radially outwardly at least to the cross-sectional circumferential contour of the plate cylinder, with the clamped bend of the trailing edge of the printing plate being displaceable back within the contour of the plate cylinder.

11 Claims, 3 Drawing Sheets

CLAMPING AND TENSIONING DEVICE FOR A PRINTING PLATE IN A PRINTING MACHINE

The invention relates to a clamping and tensioning device for an inwardly bent trailing or rear edge of a flexible printing plate in an axial gap at the circumference of a plate cylinder of a printing machine.

Such a clamping and tensioning device has become known heretofore from German Patent 41 28 994, which describes the device as including two clamping bars extending parallel to one another in an axial gap at the circumference of a plate cylinder and being formed with clamping surfaces disposed opposite one another and defining therebetween a clamping slot for receiving therein the bent trailing edge of a printing plate, the kinked edge of the bend being disposed a given distance radially within the somewhat circular cross-sectional contour or shape of the plate cylinder. A rear clamping or tensioning bar, as viewed in tensioning direction, is braced against the plate cylinder in the gap as a double lever acting radially to the cylinder axis, and is pivotable by a pneumatic adjustment element in the plate cylinder against the biasing action of a spring loading the clamped end in the tensioning direction of the printing plate tautened on the circumference of the plate cylinder, in order to release the tensioning and the clamping of the bent trailing edge of the printing plate in the clamping slot. Advantageously, the clamping force and the tensioning force are always defined by the springs which are braced, at the other side, against the body of the plate cylinder.

In order to force the bend of the trailing edge of the printing plate, especially in the case of automatic printing-plate clamping, so deeply into the clamping slot within the cross-sectional contour or shape of the plate cylinder that the peripheral trailing edge of the printing plate also lies within the cross-sectional contour of the plate cylinder, auxiliary devices are required such as have become known from the published Japanese Patent Document 63-191636 and the published European Patent Document 0 411 371 A2. These patent documents respectively disclose a device wherein a radially elastic roller already after the mounting or locking of the leading edge of the printing plate, presses against the circumference of the plate cylinder until the bent trailing edge of the printing plate is also introduced into the clamping slot and is clamped within the cross-sectional contour of the plate cylinder. Such auxiliary devices for the insertion of the bent trailing edge of the printing plate into the clamping or tensioning slot of a clamping device must be furnished with precautionary safety measures in order to avoid collisions between moving parts and are consequently quite costly.

It is accordingly an object of the invention to provide a clamping and tensioning device for a printing plate in a printing machine which is of the foregoing general type so that, even when automatically changing the printing plate, no auxiliary device for inserting the bend at the rear or trailing end of the printing plate into the clamping slot of the clamping and tensioning device is required.

With the foregoing and other objects in view, there is provided, in accordance with the invention, a clamping and tensioning device for an inwardly bent trailing edge of a flexible printing plate disposed in an axial gap at the circumference of a plate cylinder adjustable in axial spacing and cooperating with a blanket cylinder, the printing plate being fixable at a leading edge thereof on the plate cylinder and being tensionable in circumferential direction on the plate cylinder, comprising two clamping bars displaceably supported in the axial gap and forming therebetween a clamping slot for receiving therein an inwardly bent trailing edge of the printing plate, the two clamping bars extending axially in the gap within the cross-sectional contour of the plate cylinder and being loadable by reversible opposing clamping forces as well as by reversible tensioning forces in common in tensioning direction of the printing plate, and being respectively braced against the plate cylinder, the two clamping bars being formed with radially outer edges, the clamping and tensioning device being radially displaceably disposed in the axial gap of the plate cylinder, and means for applying drive forces to the clamping and tensioning device for displacing the clamping and tensioning device with the radially outer edges of the two clamping bars radially outwardly at least to the cross-sectional circumferential contour of the plate cylinder, with the clamped bend of the trailing edge of the printing plate being displaceable back within the contour of the plate cylinder.

Such a construction permits the clamping bars of the clamping device to be driven radially out of the axial gap of the plate cylinder at least so far that the radially outer bordering or limiting surfaces of the clamping bars are disposed beyond or outside the cross-sectional contour of the plate cylinder. The insertion of the bend at the rear or trailing end of the printing plate into the clamping slot, the radially outer region of which is then located substantially in the cross-sectional contour of the plate cylinder, then takes place due to a rotary movement of the blanket cylinder, so that the blanket cylinder forces the bend into the clamping slot.

The clamping and tensioning device is thereafter withdrawn with the clamped bend of the printing plate radially inwardly in a direction towards the axis of the plate cylinder until it is in a stable stop position wherein the peripheral rear or trailing edge of the printing plate is located within the cross-sectional contour of the plate cylinder. In order that the rubber blanket of the blanket cylinder will reach the rear or trailing edge of the printing plate, the axially extending gap of the blanket cylinder must be suitably narrow in order to achieve an adequate offset with respect to the axial gap of the plate cylinder. It is also possible, however, for the duration of the clamping of the printing plate, to rotate the blanket cylinder with respect to the plate cylinder, so that the blanket cylinder reaches the rear or trailing bend of the printing plate and forces it deeply into into the clamping slot of the radially outwardly driven clamping and tensioning device.

In accordance with another feature of the invention, the bent trailing edge of the printing plate is forcible by the blanket cylinder into the clamping slot formed between the radially outwardly displaced clamping bars. A stable construction with form-locking transmission of the clamping and tensioning forces to the body of the plate cylinder is thus achieved. In this regard, a form-locking connection is one which connects two elements together due to the shape of the elements themselves, as opposed to a force-locking connection, which locks the elements together by force external to the elements.

In accordance with a further feature of the invention, a radially displaceably guided frame is received in the axial gap, the clamping bars being displaceably disposed in the frame, the clamping and tensioning forces acting upon the clamping bars being braced, on the other hand, against the frame. This permits the advantages mentioned hereinbefore with respect to the German patent to be retained with the invention of the instant application.

In accordance with an added feature of the invention, the device includes spring means for applying bracing spring forces against the plate cylinder and therethrough applying a radially inward load to the frame, and pneumatically actuatable adjusting means for displacing the frame, against the forces of the spring means, radially outwardly to a take-up position for the bend of the printing plate through the clamping bars.

In accordance with an additional feature of the invention, the device includes roller bearings disposed in guide means in the gap formed in the plate cylinder for guidingly supporting the frame.

In accordance with yet another feature of the invention, the two clamping bars are braced against one another in a calotte-shaped joint, and the two clamping bars are braced by respective inner ends thereof against the frame, and spring means are included for applying a load to respective outer ends of the two clamping bars in tensioning direction of the printing plate on the circumference of the plate cylinder.

In accordance with yet a further feature of the invention, one of the clamping bars disposed behind the other in the tensioning direction of the printing plate serves as a tensioning bar and, radially within the calotte-shaped joint, both of the clamping bars are tiltably mounted in the frame on a shaft extending axially in the gap of the plate cylinder.

In accordance with yet an added feature of the invention, there are included a pneumatically actuatable adjusting device braced against the frame and engaging the inner end of the one clamping bar serving as a tensioning bar, and tensioning spring means for applying tensioning forces for permanently loading the clamping bars against one another in the clamping slot and for permanently loading the clamping bars in common in the tensioning direction of the printing plate, the adjusting device, when actuated, overcoming the tensioning forces of the tensioning spring means.

In accordance with yet an additional feature of the invention, the frame, in cross section, in the axial gap is substantially U-shaped and is formed with a base web surface by which it is braced against pneumatically actuatable adjusting means in the axial gap, and is loaded at radially outwardly directed leg ends by spring means acting radially towards the middle of the plate cylinder.

In accordance with another feature of the invention, the tensioning spring means applies a load to the one clamping bar serving as a tensioning bar, the one clamping bar being braced substantially centrally with a spherical bracing bearing against one leg of the U-shaped frame, the tensioning spring means being braced, on one side, against the radially inner end of the one clamping bar serving as a tensioning bar and, on the other side, near the base web surface, against the other leg of the U-shaped frame.

In accordance with a concomitant feature of the invention, the frame is formed on opposite sides thereof with support surfaces extending substantially tangentially to the axis of the plate cylinder, and counter-surfaces extending parallel to the support surfaces in the axial gap of the plate cylinder, the spring means acting radially towards the middle of the plate cylinder being disposed pretensioned between the support surfaces and the counter-surfaces.

Other features which are considered as characteristic for the invention are set forth in the appended claims.

Although the invention is illustrated and described herein as embodied in a clamping and tensioning device for a printing plate in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
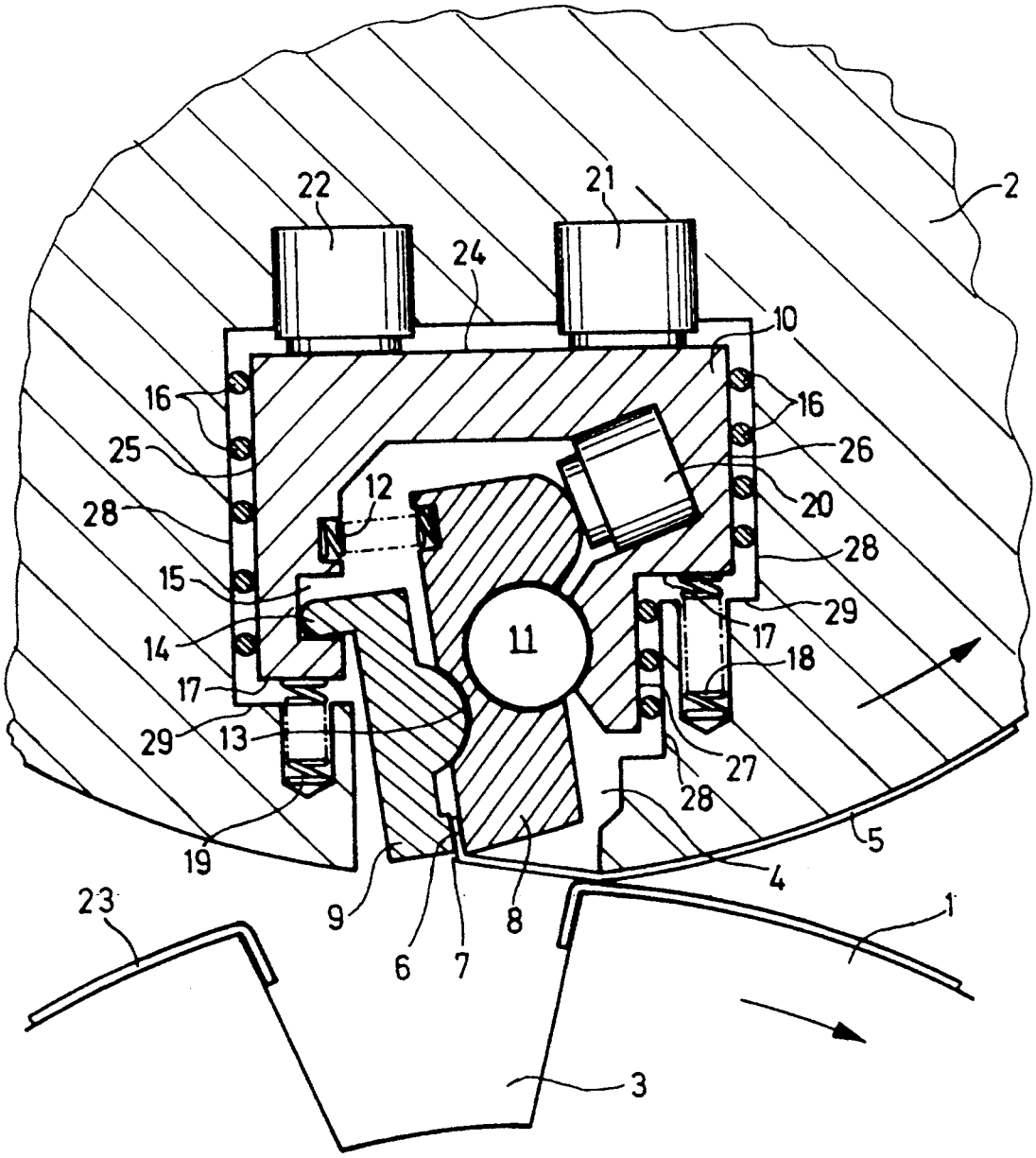
FIG. 1 is a cross-sectional view of a fragment of a plate cylinder and of an axial gap formed therein, as well as of a clamping and tensioning device received in the axial gap and disposed therein in printing position.
Figure 2:
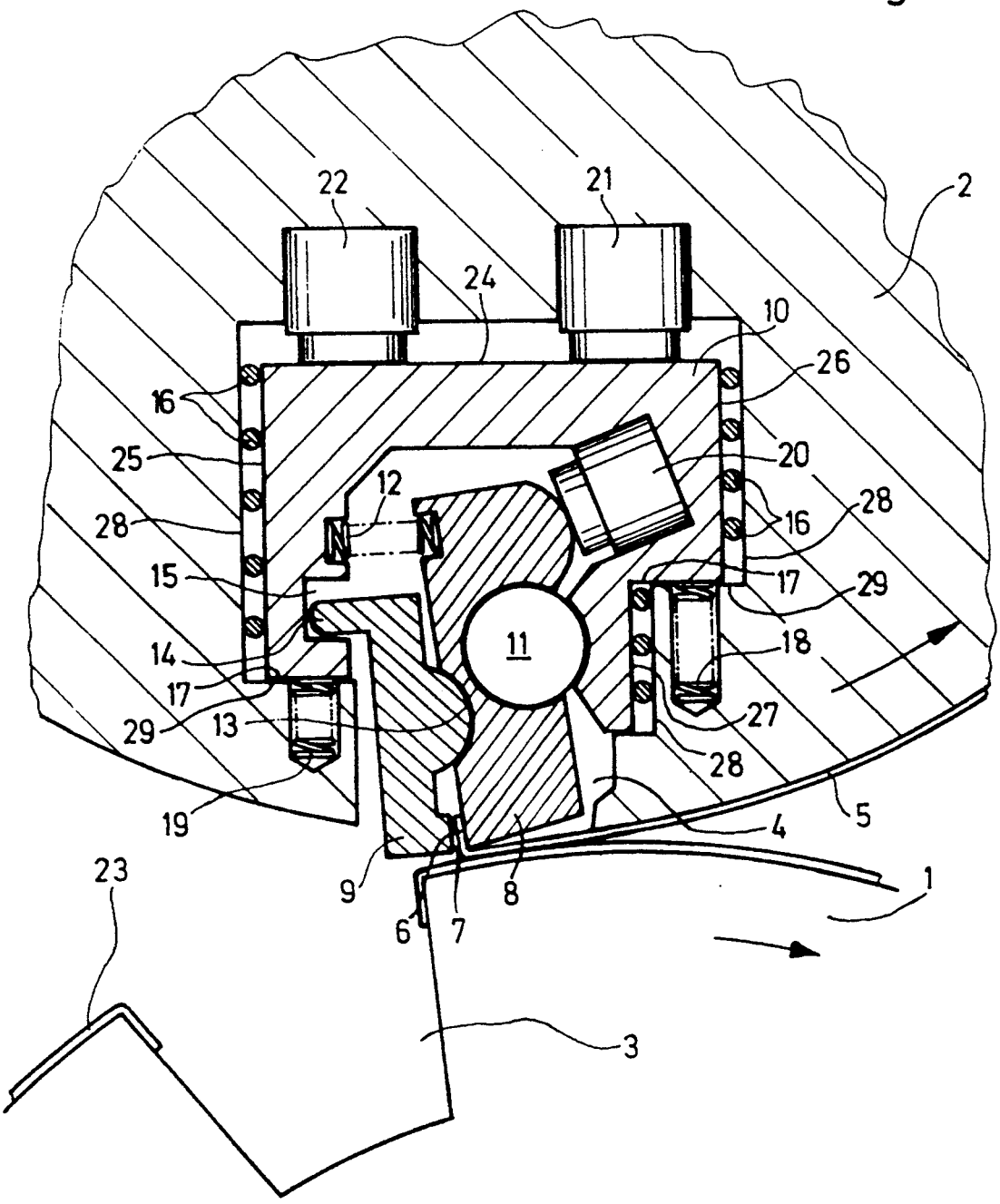
FIG. 2 is a view like that of FIG. 1 wherein the clamping and tensioning device is shown in tensioning position.

Referring now to the figures of the drawings, there are shown therein a blanket cylinder 1 and a plate cylinder 2 of an offset sheet-fed rotary printing machine. The blanket cylinder 1 is formed with an axially extending gap at the circumference thereof, and a rubber blanket 23 is stretched around the outer cylindrical surface of the blanket cylinder 1. The plate cylinder 2 is also formed with an axially extending open gap 4 at the circumference thereof. A clamping device for a printing plate 5 which is tensionable or tightenable on the circumference of the plate cylinder 2 is arranged in the open gap 4. The printing plate 5 has a rear or trailing edge formed with a radially inwardly directed bend 6 engaging in a clamping slot 7 formed in the clamping and tensioning device according to the invention wherein the trailing end of the printing plate 5 is clamped and is tensioned or tightened by the printing plate 5 on the circumference of the plate cylinder 2. This clamping device has two clamping bars 8 and 9 with outer ends, as viewed in cross section, formed with clamping surfaces which enclose the clamping slot 7. Both of the clamping bars 8 and 9 are arranged in a frame 10 extending, in the gap 4 formed in the plate cylinder 2, substantially radially displaceably, so that both of the clamping bars 8 and 9 with the clamping slot 7 are withdrawable at least partly out of the cross-sectional contour or shape of the plate cylinder 2 and radially inwardly to such an extent that the peripheral trailing edge of the printing plate 5 is disposed within the cross-sectional contour of the plate cylinder 2. The rear clamping bar, as viewed in tensioning or tightening direction of the printing plate 5, i.e., the clamping bar 8, is formed in cross section as a double lever having a substantially central shaft 11, shaft projections or the like which are supported in a spherical channel formed in the frame 10. An inner end of the double lever 8 is permanently loaded and biased by a pretensioned spring 12 in the direction of tensioning of the printing plate 5 on the circumference of the plate cylinder 2. On the opposite side of the inner end of the double lever 8 from the spring 12 and effective against the double lever 8 is an advantageously pneumatically operating adjusting unit 20 which, when actuated, swings the double lever 8 against the spring 12, in order to release the tension of the printing plate 5 on the plate cylinder 2 and, simultaneously, the clamping device. The other clamping bar 9 has a spherical projection 13 likewise somewhat central thereto, as viewed in cross section, the projection 13 being braced radially beyond the axis of the shaft 11 against the clamping bar 8 in a spherical channel or pan formed in the latter. The inner end of the clamping bar 9 is formed with a projection 14 by which it engages in a recess 15 formed in the frame 10, as a result of which the clamping bar 9, on the one hand, is retained in the illustrated position thereof shown in FIG. 1 and, on the other hand, is adequately movable, however, for tensioning and releasing the tensioning and clamping device.

Of advantage is the somewhat U-shaped frame 10, as viewed in cross section, which is formed with a base web surface 24, a flat outer web surface 25 on one outer side and flat partial area surfaces 26 and 27 on the other outer side of the respective legs thereof. Guidance of the frame 10 in guide surfaces 28 of the gap 4 of the plate cylinder 2 by means of linear roller bearings 16 is thereby possible in order to achieve an easy-acting and play-free mobility of the frame 10. The trough-shaped frame 10, which is U-shaped in cross section, is insertable from an end face thereof axially into the gap 4 of the plate cylinder 2 and engages, with somewhat tangentially extending support surfaces 17, under somewhat parallel extending counter-surfaces 29 formed in the gap 4 of the plate cylinder 2. Between these support surfaces 17 and the body of the plate cylinder 2, springs 18 and 19 are pretensioned on both sides of the gap 4 and apply a biasing load permanently against the frame 10 in a direction towards the axis of the plate cylinder 2.

Figure 3:
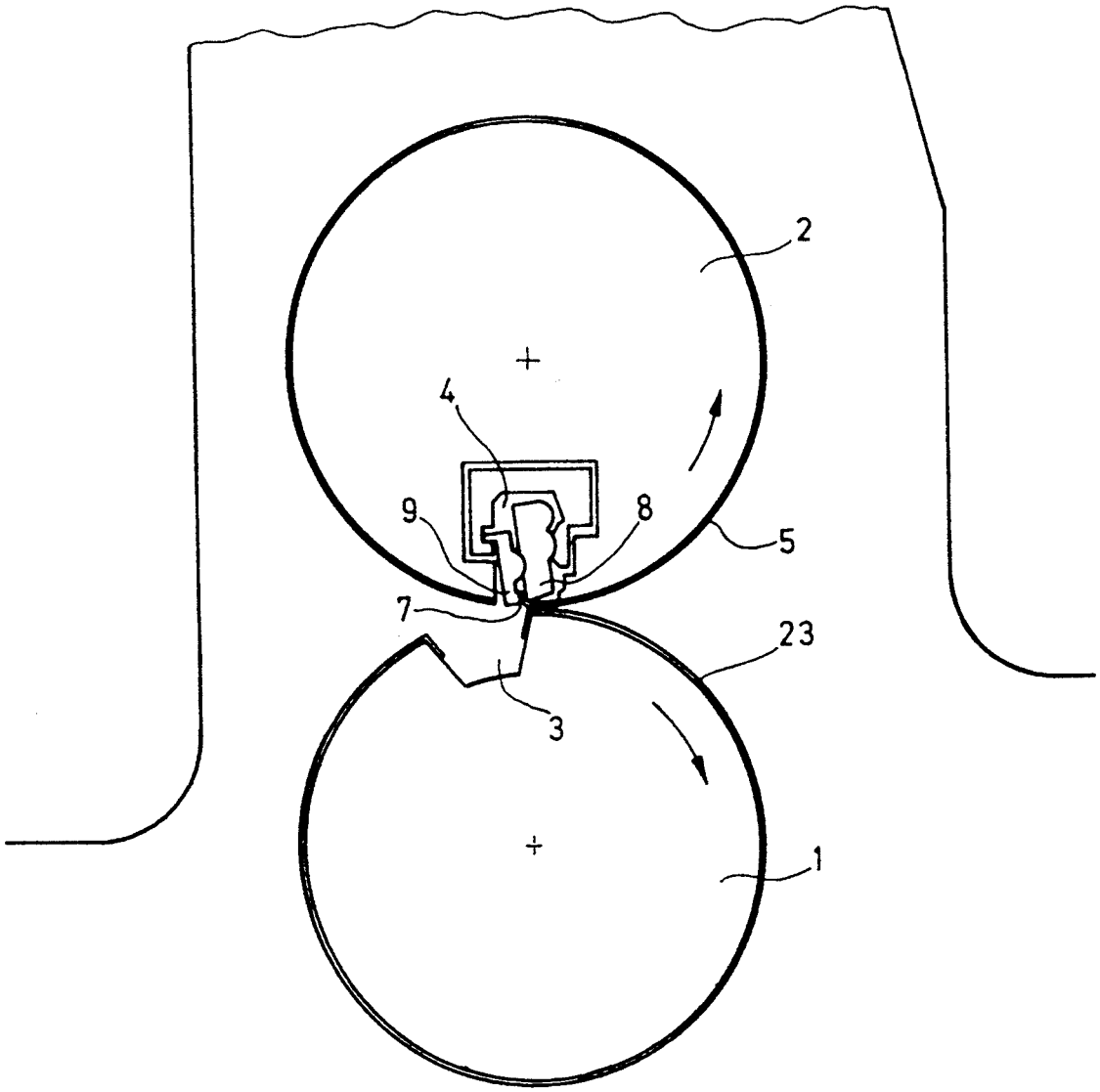
FIG. 3 is a fragmentary diagrammatic side elevational view of a printing unit having a plate cylinder and a blanket cylinder in an operating-phase position thereof for inserting a bend of a printing plate into a clamping slot formed in the device.

Under the frame 10, advantageously, pneumatically operated adjusting units 21 and 22 are arranged which, in non-loaded condition, permit a radially inwardly directed form-locking force transmission. As noted hereinbefore, a form-locking connection is one which connects two elements together due to the shape of the elements themselves, as opposed to a force-locking connection, which locks the elements together by force external to the elements. In the circumferential direction, this form-locking force transmission takes place through the roller bearing members 16. With the pneumatic energization of the adjusting units 21 and 22, the force of the springs 18 and 19 is overcome, so that the frame 10 is driven together with the clamping bars 8 and 9 to the outside and the clamping slot 7 at least partly out of the region of the cross-sectional contour of the plate cylinder 2. Pneumatically actuating the adjusting unit 20 acting against the inner end of the clamping bar 8 causes the force of the spring 12 to be overcome, so that the clamping bar 8 is swung about the shaft 11, and the clamping slot 7 is opened. In this position, the printing plate 5 can be pressed, by the rotation of the mutually engaged blanket cylinder 1 and plate cylinder 2, against the circumference of the plate cylinder 2 and, simultaneously, the trailing or rear bend 6 of the printing plate 5 can be pressed into the clamping slot 7. The clamping of the bend 6 occurs with the release or removal of the actuating load applied to the adjusting unit 20. By releasing the the adjusting units 21 and 22, the springs 18 and 19 press the frame 10 with the clamping bars 8 and 9 radially inwardly into a stable stop position wherein the peripheral rear or trailing bend 6 of the printing plate 5 is disposed within the cross-sectional contour of the plate cylinder 2. Further auxiliary means are unnecessary for this purpose. No special device for pushing in the rear or trailing bend 6 of the printing plate 5 is required. Care should be taken only that the circumference of the blanket cylinder 1 reaches the rear or trailing bend 6 of the printing plate 5. This can be attained by a suitably narrowly formed gap 3 in the blanket cylinder 1 or, if necessary or desirable, by a transitory rotation of the blanket cylinder 1 with respect to the plate cylinder 2 during the actuation of the clamping device, as is shown diagrammatically in FIG. 3.

We claim:

1. Clamping and tensioning device for a printing plate in a printing machine, wherein the printing plate is a flexible printing plate having an inwardly bent trailing edge, and the printing machine includes a plate cylinder defining axial and radial directions and having an axial gap formed therein, a blanket cylinder disposed in a spaced-apart relationship with the plate cylinder, the clamping and tensioning device comprising:

two clamping bars displaceably supported in said axial gap formed in said plate cylinder and extending in an axial direction of the plate cylinder, said two clamping bars having radially outer edges as seen in a radial direction of the plate cylinder, and said two clamping bars defining a clamping slot therebetween for receiving said inwardly bent trailing edge of a printing plate;

means for applying reversible clamping forces on said two clamping bars for clamping the bent trailing edge of the printing plate therebetween; and means for displacing said two clamping bars in a radial direction of the plate cylinder, said displacing means diplacing said radially outer edges of said two clamping bars radially outwardly at least to a circumferential periphery of the plate cylinder, and displacing said two clamping bars radially inwardly with the bent trailing edge of the printing plate clamped between said two clamping bars for tensioning the printing plate on the plate cylinder.

2. The device according to claim 1, including means for varying an axial distance between the blanket cylinder and the plate cylinder and for forcing the bent trailing edge of the printing plate into said clamping slot formed between said radially outwardly displaced clamping bars with the blanket cylinder.

3. Device according to claim 1, including a radially displaceably guided frame received in the axial gap, said clamping bars being displaceably disposed in said frame, the clamping and tensioning forces acting upon said clamping bars being braced against said frame.

4. Device according to claim 3, including spring means braced against the plate cylinder for biasing said frame radially inwardly, and pneumatically actuatable adjusting means for displacing said frame, against said spring means, radially outwardly to a take-up position at which said clamping bars receive the bent trailing edge of the printing plate.

5. Device according to claim 3, including roller bearings disposed in the axial gap formed in the plate cylinder for guidingly supporting said frame.

6. Device according to claim 3, wherein the plate cylinder defines a tensioning direction of the printing plate, and wherein said two clamping bars have radially inner ends braced against said frame, and a calotte-shaped joint formed between said two clamping bars and bracing said two clamping bars against one another, and including tensioning spring means for biasing said outer ends of said two clamping bars in the tensioning direction of the printing plate on the circumference of the plate cylinder.

7. Device according to claim 6, wherein one of said clamping bars disposed behind the other in the tensioning direction of the printing plate serves as a tensioning bar, and including a shaft extending axially in the gap of the plate cylinder, both of said clamping bars being tiltably mounted in said frame on said shaft.

8. Device according to claim 7, including a pneumatically actuatable adjusting device braced against said frame and engaging the inner end of said one clamping bar serving as a tensioning bar, and tensioning spring means for applying tensioning forces for permanently loading said clamping bars against one another in said clamping slot and for permanently loading said clamping bars in common in the tensioning direction of the printing plate, said adjusting device, when actuated, overcoming said tensioning forces of said tensioning spring means.

9. Device according to claim 8, including pneumatically adjusting means disposed in the axial gap, said frame, in cross section, being substantially U-shaped and having a base web surface by which said frame is braced against said pneumatically actuatable adjusting means in the axial gap, and including further spring means acting on leg ends of said U-shaped frame for biasing said frame radially inwardly towards the middle of the plate cylinder.

10. Device according to claim 9, wherein said tensioning spring means applies a load to said one clamping bar serving as a tensioning bar, and including a spherical bracing bearing bracing said one clamping bar substantially centrally against one leg of said U-shaped frame, said tensioning spring means being braced, on one side, against the radially inner end of said one clamping bar serving as a tensioning bar and, on the other side, near said base web surface, against the other leg of said U-shaped frame.

11. Device according to claim 9, wherein said frame is formed on opposite sides thereof with support surfaces extending substantially tangentially to the axis of the plate cylinder, and counter-surfaces extending parallel to said support surfaces in the axial gap of the plate cylinder, said further spring means acting radially towards the middle of the plate cylinder being disposed pretensioned between said support surfaces and said counter-surfaces.

* * * * *